US008366462B2

(12) United States Patent
Kuo

(10) Patent No.: US 8,366,462 B2
(45) Date of Patent: Feb. 5, 2013

(54) RETRACTABLE POWER PLUG

(75) Inventor: Ming-Chou Kuo, Taipei (TW)

(73) Assignee: Powertech Industrial Co., Ltd., Taipei Hsien (TW)

( * ) Notice: Subject to any disclaimer, the term of this patent is extended or adjusted under 35 U.S.C. 154(b) by 0 days.

(21) Appl. No.: 13/468,286

(22) Filed: May 10, 2012

(65) Prior Publication Data

US 2012/0220150 A1 Aug. 30, 2012

Related U.S. Application Data

(62) Division of application No. 12/897,112, filed on Oct. 4, 2010, now Pat. No. 8,197,267.

(30) Foreign Application Priority Data

Jul. 9, 2010 (TW) ..... 99122695 A

(51) Int. Cl.
*H01R 13/44* (2006.01)

(52) U.S. Cl. ..... 439/131; 439/141

(58) Field of Classification Search ..... 439/131, 439/140, 141
See application file for complete search history.

(56) References Cited

U.S. PATENT DOCUMENTS

| | | | | |
|---|---|---|---|---|
| 3,926,494 | A * | 12/1975 | Maillaro | 439/131 |
| 5,334,032 | A * | 8/1994 | Myers et al. | 439/140 |
| 6,062,881 | A * | 5/2000 | Ellison | 439/141 |
| 6,176,712 | B1 * | 1/2001 | Huang | 439/140 |
| 6,808,400 | B2 * | 10/2004 | Tu | 439/131 |
| 7,104,814 | B1 * | 9/2006 | She et al. | 439/131 |
| 8,043,101 | B2 * | 10/2011 | Zhang et al. | 439/133 |
| 8,197,267 | B2 * | 6/2012 | Kuo | 439/131 |
| 2001/0034147 | A1 * | 10/2001 | Kerr et al. | 439/141 |
| 2008/0076280 | A1 * | 3/2008 | Chi et al. | 439/131 |
| 2012/0009807 | A1 * | 1/2012 | Kuo | 439/131 |
| 2012/0220150 | A1 * | 8/2012 | Kuo | 439/310 |

* cited by examiner

*Primary Examiner* — James Harvey
(74) *Attorney, Agent, or Firm* — Rosenberg, Klein & Lee

(57) ABSTRACT

A retractable power plug applied for an electronic apparatus or an extension outlet is disclosed. The retractable power plug includes a housing, a base, a movable unit and a plurality of prongs. The housing has a space for enclosing the base. The prongs are pluggably disposed on the base. The base is rotatably and movably located in the space. The movable unit is configured to prompt the base to move in the space. The direction of movement of the base is generally parallel with the connection direction of the prongs. So that, the prongs associated with the base is capable of moving up and down in the space.

2 Claims, 5 Drawing Sheets

RETRACTABLE POWER PLUG

RELATED APPLICATIONS

This application is a Divisional patent application of co-pending application Ser. No. 12/897,112, filed on 4 Oct. 2010. The entire disclosure of the prior application, Ser. No. 12/897,112, from which an oath or declaration is supplied, is considered a part of the disclosure of the accompanying Divisional application and is hereby incorporated by reference.

BACKGROUND OF THE INVENTION

1. Field of the Invention

The present invention relates to a power plug, in particular, to a power plug with retractable prongs.

2. Description of Related Art

Responsive to the portability of modern electric appliances, the related designs have tendency to be thinner and light weight. Thus, any protruded prong becomes disadvantageous to pack up the portable appliances since the prong may occupy extra space. The prong may scrape the other articles, or be bent or deformed by extrusion.

For this reason, it conducts a topic for the skilled person in the art to pack up the plug with prongs conveniently.

SUMMARY OF THE INVENTION

One of the objectives of the instant disclosure is to provide a retractable power plug, which can hide the protruding prongs into the power plug. Therefore, the plug becomes more convenient to pack up and carry safely.

For the above-described objective, the provided approach with respect to the retractable power plug is particularly adapted to any appliance having a plug or to the extension outlet with a plug. The retractable power plug has a housing, a base and a plurality of prongs. The housing includes a space which is used to enclose a base. The prongs are pluggably disposed on the base. In particular, the base is rotatably and movably disposed in the space. The direction of movement of the base is generally parallel with the connection direction of the prongs. Therefore, the prongs on the base may retract back or expose out freely in the space.

One more aspect in the instant disclosure is regarding a retractable power plug having a housing, a base, a plurality of prongs and a movable unit. The housing also has space. The base is capable of rotatably retracting back or exposing out in the space. The prongs are separately disposed on the base. The movable unit is movably disposed in the space, and its movement jointly drives the base moving within the space. The direction of movement of the base is generally parallel with the connection direction of the prongs. The prongs can retract back or expose out along with the base, and are allowed to be enclosed within the space, or exposed out of the housing.

These and other various advantages and features of the instant disclosure will become apparent from the following descriptions and claims, in conjunction with the appended drawings.

DETAILED DESCRIPTION OF THE PREFERRED EMBODIMENTS

Figure 1A:
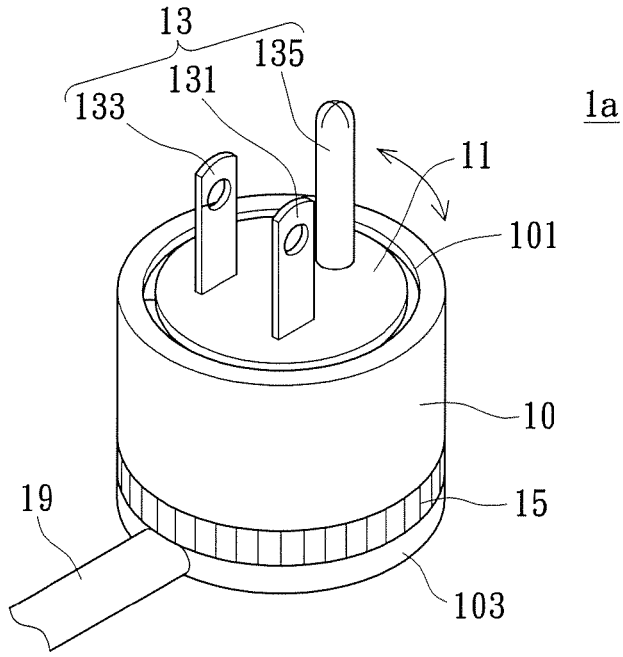
FIG. 1A through 1C shows a schematic diagram of the first embodiment of a retractable power plug in accordance with the present invention.
Figure 1B:
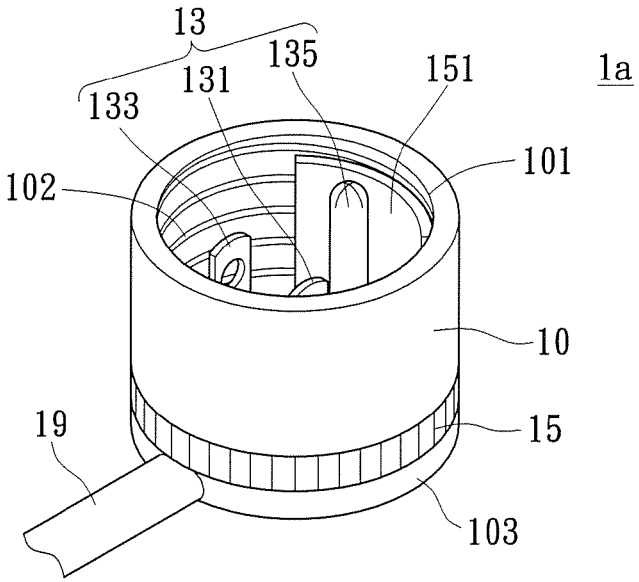
Figure 1C:
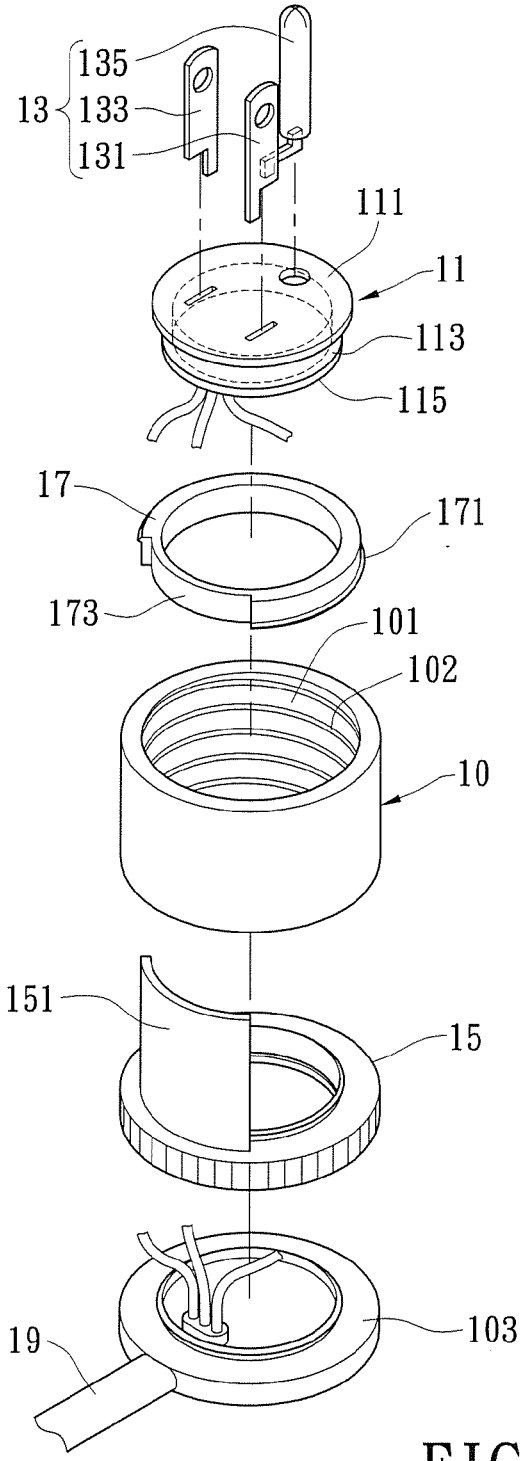

FIG. 1A through FIG. 1C schematically show the first embodiment of a retractable power plug in accordance with the present invention. In FIG. 1A, the retractable power plug has a housing 10, a base 11, a plurality of prongs 13 and a rotatable element 15. The housing 10 is connected with an electric wire 19. Further, the housing 10 has an internal space 101 for sufficiently enclose all external conducting elements which would normally be outside the housing during use, for example, the base 11. In particular, the ends of the conducting prongs 13 are separately pluggably disposed on the base 11, and used to electrically connect to the electric wire 19. Each prong is disposed one the base 11 and electrically separated from each other. In an example, the prongs 13 are electrically connected to the wire 19 through a conductive slice or a conductive ring (not shown). Further, the rotatable element 15 is pivoted with the housing 10, in order to provide the user to control the position of the base 11 within the space 101. Thus the base 11 moves toward the housing 10 along the connection direction of the prongs 13. The prongs 13 therefore can be retracted within the space 101 or exposed out of the housing 10.

Furthermore, the base 11 can move within the space 101 from the surface of housing 10 to the interior of the housing 10. The base 11 does not stop until the prongs 13 are entirely enclosed within the space 101.

In an example shown in FIG. 1B, if the retractable power plug 1*a* is used to take power, the rotatable element 15 may drive the base 11 up to the surface of housing 10. Such as FIG. 1A, the retractable power plug 1*a* can be used to install on a wall-type socket, or an extension outlet (not shown). The claimed plug occupies smaller space since it can be retracted. Therefore the prongs 13 will not be exposed and make it easier to carry, and furthermore, it does not hook or scratch other articles.

For specifically describing the movements of prongs 13 of the claimed retractable power plug 1*a*, reference is made to FIG. 1C showing an explode diagram of the plug in the first embodiment. The retractable power plug 1*a* further includes a ring 17 disposed within a space 101 and between the base 11 and the rotatable element 15 in addition to the housing 10, the base 11, the plurality of prongs 13 and the rotatable element 15. The ring 17 and a corresponding guiding portion 102 are inside the housing 10. The ring 17 moves along the guiding portion 102 and within the housing 10. In particular, the rotatable element 15 and the ring 17 are formed as a movable unit (not shown) of the retractable power plug 1*a*. The movable unit jointly drives the base 11 up and down in the space 101.

In the current embodiment, a protruding portion 171 and at least one notch portion 173 are disposed outside the ring 17. The thickness and width of the guiding portion 102 match the design of protruding portion 171 for properly guiding the protruding portion 171 moving along the guiding portion 102. Therefore, the ring 17 can move up and down in the housing 10.

The rotatable element 15 has a push-against portion 151 which extends to the base 11. The notch portion 173 outside the ring 17 is wedged with the push-against portion 151. When the rotatable element 15 clockwise or counterclockwise rotates with respect to the housing 10, the push-against portion 151 will push the protruding portion 171 to move along the guiding portion 102. Since the ring 17 moves inward or outward relative to the sidewall of housing 10, the ring 17 may synchronously push the upper base 11 moving inward or outward.

In one embodiment, the protruding portion 171 can be one or more ring flanges or at least one screw thread. The guiding portion 102 can be designed as an impressed spiral trench corresponding to the size of the flange. Through the rotatable element 15, the flange is allowed to move along the spiral trench. In the meanwhile, the position of the mentioned ring 17 changes along with the housing 10.

It is worth noting that the base 11 may not follow the ring 17 to moving inward or outward since the plug 1*a* is configured to prevent the electric wire 19 connected with the base 11 from damage by twisting. The outer surface of the base 11 is levelly rotatable to the housing 10. However, the rotatable base 11 is independent of the ring 17 relative to the housing 10. Following describes how the base 11 is rotatably disposed within the space 101.

The base 11 includes a cover plate 111, a side plate 113, and a bottom plate 115. The prongs 13 are pluggably disposed on the cover plate 111. The side plate 113 and the bottom plate 115 can be immovably combined. The electric wire 19 is soldered to or adhesive to the side plate 113 or the bottom plate 115. The prongs 13 prop with the electric wire 19 via a conductive slice. The cover plate 111 is rotatable with respect to the side plate 113 and the bottom plate 115, namely the prongs 13 is levelly rotatable to the housing 10. The prongs 13 may keep contact with the electric wire 19 rather than separation.

Therefore, when the retractable power plug 1*a* is plugged to a socket, the electric wire 19 connected with the side of housing 10 can be rotated with any angle. For example, the rotated angle can be 360 degree. The plug's flexibility can be enhanced since its connection direction is not restricted.

According to the embodiment in accordance with the present invention, the outer appearance of the housing 10 may be any shape such as a cylinder or a polygonal cylinder. The electric wire 19 may connect with the side or bottom of the housing 10. The rotatable element 15 may be disposed on the bottom or side of the housing 10. The prongs 13 may be two or three prongs. In which, a first prong 131 and a second prong 133 are respectively a live contact and a neutral contact if two-prong example is introduced. Preferably, the two polarities of the first prong 131 and the second prong 133 can be exchanged. For a three-prong example, the first prong 131, the second prong 133 and a third prong 135 are included, and the first prong 131 and the second prong 133 are respectively the live contact and the neutral contact, and the third prong 135 is an earth contact.

In a first embodiment of the retractable power plug 1*a*, the ring 17 of the rotatable element 15 jointly rotatable and movable is merely one of the embodiments. In practice, the ring 17 may also be levelly rotated or vertically moved. For example, the push-against portion 151 can be formed on the bottom 103, and the housing 10 is pivoted to the bottom 103. So that the rotatable element 15 can be omitted. Its protruding portion 171 and notch portion 173 can be formed on the base 11. The notch portion 173 and the push-against portion 151 are entangled with each other. The guiding portion 102 on the inner wall of the housing 10 may be a spiral trench. When the housing 10 rotates clockwise or counterclockwise relative to the bottom 103, the push-against portion 151 is used to confine the rotation of the base 11 along with the notch portion 173. The protruding portion 171 of base 11 moves along with the guiding portion 102 on the sidewall of the housing 10. Therefore, the base 11 may freely move inward or outward.

Figure 2:
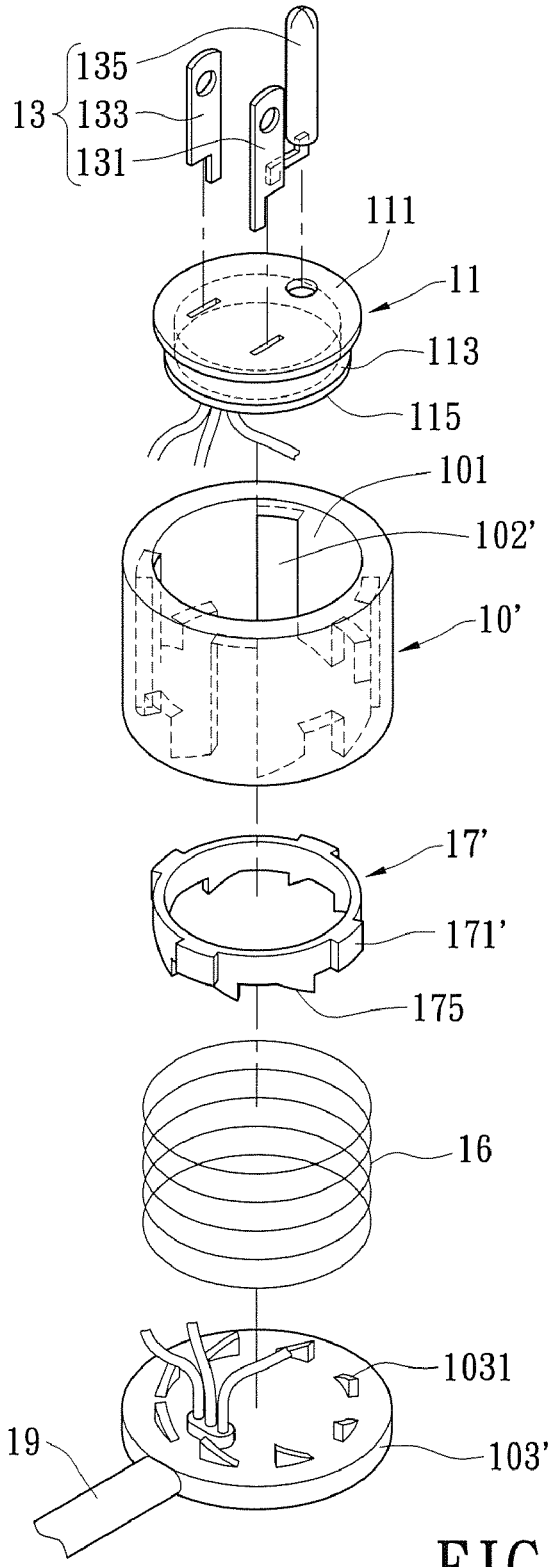
FIG. 2 shows a schematic diagram of the second embodiment of the retractable power plug in accordance with the present invention.

Next reference is made to FIG. 2 showing an explode diagram of the second embodiment of the retractable power plug. The retractable power plug 1*b* of this second embodiment is similar to the first embodiment. A ring 17' is also introduced to drive the upper base 11 moving inward or outward. Rather than the first embodiment, the retractable power plug 1*b* of the second embodiment has no rotatable element 15, but adds an elastic element 16. The elastic element 16 and the ring 17' form a movable unit of the retractable power plug 1*b*. This movable unit especially drives the base 11 moving inward or outward within the space 101.

In the current embodiment, the guiding portion 102' inside the housing 10' can be a plurality of long trenches. The direction of the plural long trenches is parallel with the connection direction of the prongs 13. The long trenches especially extend up from bottom of the housing 10'. The trenches have two different depths, and two trenches with the two different depths are arranged alternately. The protruding portion 171' outside the ring 17' is formed with many bumps. The bumps correspond to the long trenches. That means the bumps can be selectively distributed over the trenches with different depths.

When the bumps are simultaneously distributed over the trenches with shallower depths, the ring 17' can be buried inside the space 101, and the base 11 and the prongs 13 can be enclosed within the space 101. When the bumps are distributed over the shallower trenches, the ring 17' can be raised around the upper surface of housing 10'. Therefore, the base 11 may move up to the surface of housing 10', and the prongs 13 can be exposed out the space 101.

The elastic element 16, in the current embodiment, is disposed below the ring 17'. The elastic element 16 and the ring 17' are propped with each other. The protruding portion 171' of the ring 17' is disposed in the deepest position of the guiding portion 102', namely the bottom of the long trenches. In particular, a plurality of first one-way teeth 1031 are disposed on the upper surface of bottom 103' of housing 10', and a plurality of second one-way teeth 175 are at lower edge of the ring 17'. The position of the first one-way teeth 1031 corresponds to the position of the second one-way teeth 175, and they can be mutually slipped. Since the ring 17' is pressured from top to bottom, the ring 17' can rotate relative to the housing 10'. With every pressure, the ring 17' may rotate once, and the protruding portion 171' may alternately enter the long trenches with different depths.

Figure 3A:
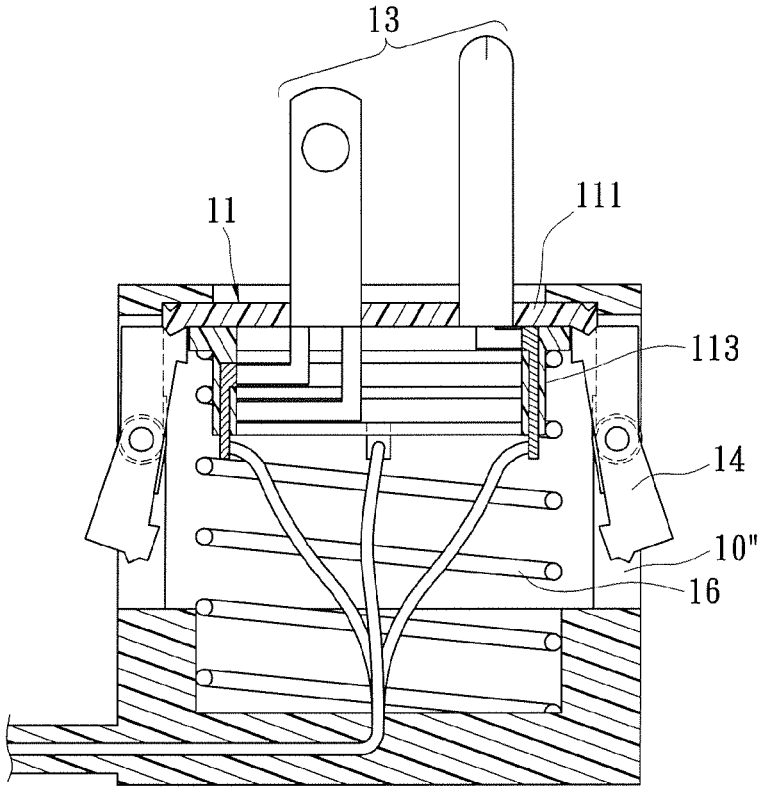
FIG. 3A through 3B schematically shows a third embodiment of the retractable power plug of the present invention.
Figure 3B:
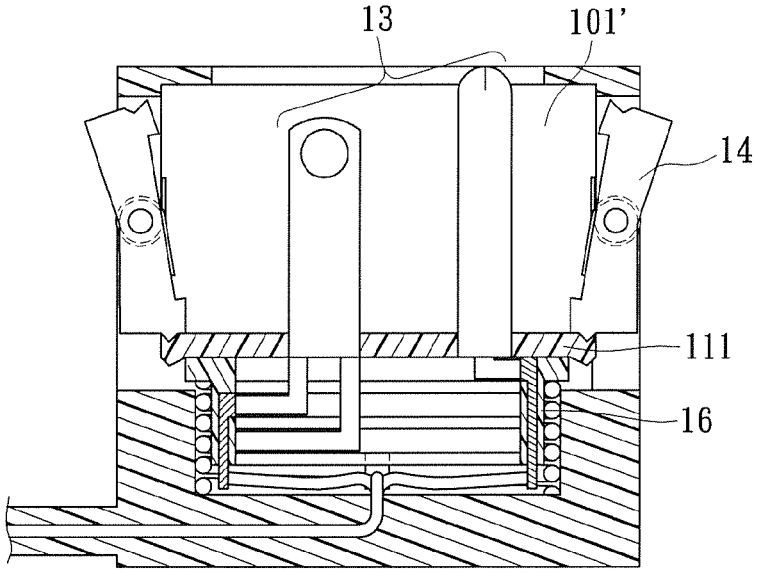

References are made to FIG. 3A and FIG. 3B. The retractable power plug in the third embodiment is similar with the plug in the second embodiment since both they use the elastic element 16 to drive the base 11. The difference is that the retractable power plug 1*c* does not have the ring 17', and the housing 10" without the guiding portion 102'. The plug 1*c* particularly has a locking unit 14 disposed on a sidewall of the housing 10" for user's operation. The locking unit 14 may follow the user's operation to lock or unlock the base 11 at a specific position. For example, the base 11 may be moved to a surface of housing 10", or be retracted within the space 101'.

The locking unit 14 preferably can be a rocker button, and its two ends may respectively be wedged with the cover plate 111 of base 11. So that, the base 11 can be immovably fixed onto the surface of housing 10" or be buried into the space 101'. In practice, the structure of the claimed plug may be modified to different embodiments. For example, the upper position of housing 10" has a closed top portion formed as a cover body. The top portion of the housing 10" includes a plurality of holes (not shown), and the bottom 103' is combined with the base 11. The mentioned elastic element 16 is located between the top portion of housing 10" and the base 11.

When the bottom 103' is pressed, the bottom 103' may move with the base 11, and the prongs 13 may expose out of the holes on the top portion of housing 10". Furthermore, one end of the locking unit 14 may be wedged with the cover plate 111 of base 11 for foxing the base 11. The elastic element 16 may be pressured into the position between the top portion of housing 10" and the base 11. The elastic element 16 may be released to push the base 11 to the original position as unlocking the locking unit 14. Therefore, the prongs 13 may be retracted into the housing 10". The top portion of the housing 10" serves as a dust-proof portion.

The locking unit 14 can also be modified for applying to the described first embodiment or the second embodiment. The locking unit 14 may be wedged with the ring 17 and the ring 17' for fixing the base 11.

Figure 4A:
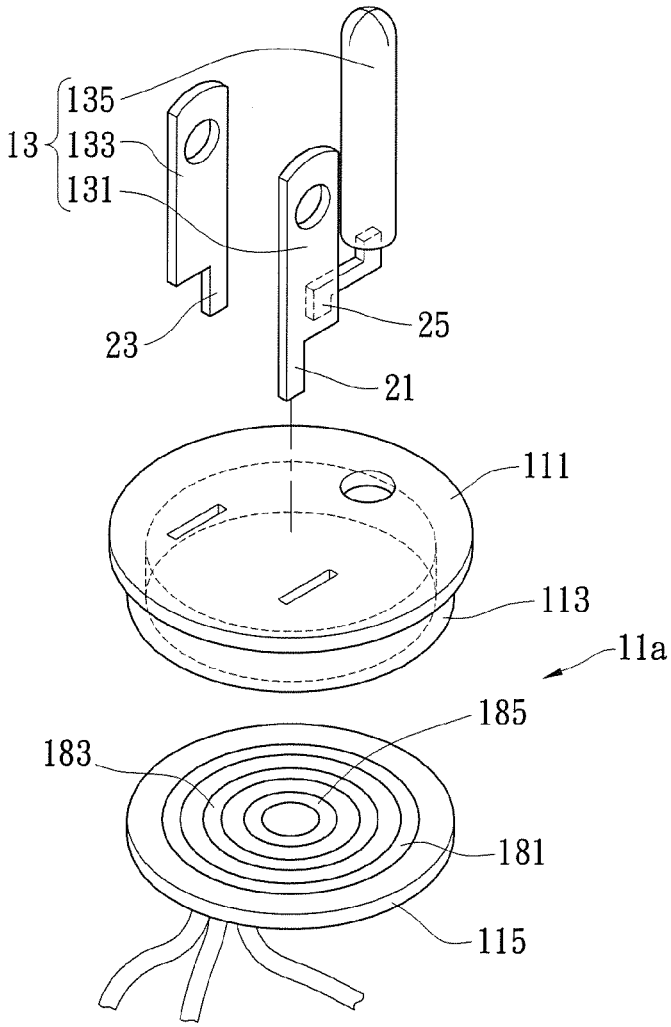
FIG. 4A shows a schematic diagram of a first embodiment of a conductive ring of the retractable power plug in accordance with the present invention.
Figure 4B:
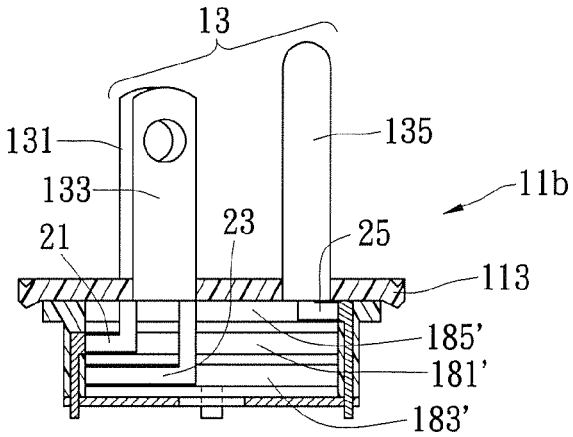
FIG. 4B shows a schematic diagram of a second embodiment of the conductive ring of the retractable power plug in accordance with the present invention.

In order to clarify the horizontal rotations of the prongs 13 with respect to the described housing 10, 10' or 10", further references are made to FIG. 4A and FIG. 4B, which are respectively the first and second embodiment of the conductive ring for the retractable power plug. In which, the bottom plate 115 and the side plate 113 of base 11 are immovably connected as one body. The one end of each prong 13 is immovably and pluggably disposed on the cover plate 111. The plurality of prongs 13 and the cover plate 111 are levelly rotatable with respect to the side plate 113 and the bottom plate 115. In the rotation, the cover plate 111 and the side plate 113 can be kept un-separable. Further, the prongs 13 and the electric wire 19 can be kept contact. As shown in FIG. 4A, there are three concentric conductive rings 181, 183, and 185 with different radiuses disposed on the bottom plate 115 of base 11*a*. The three rings 181, 183, and 185 are separately connected to the different polarities of the electric wire 19. The prongs 131, 133, and 135 individually have the extendable conductive members 21, 23, and 25. The conductive members 21, 23, and 25 are separately propped to the corresponding conductive rings 181, 183, and 185.

In particular, when the prongs 131, 133, and 135 rotate with the cover plate 11*a*, the conductive rings 181, 183, 185 and the bottom plate 115 may not be rotated therewith for preventing twist of the wire 19. However, the conductive members 21, 23, and 25 may rotate along with the cover plate 11, and always keep contact with the conductive rings 181, 183, and 185.

Reference is made to FIG. 4B, the second embodiment of the conductive ring may have three conductive rings 181', 183', and 185' with the same size. The three rings 181', 183', and 185' are separately disposed on the inner of side plate 113 of the base 11*b*. The prongs 131, 133, and 135 are correspondingly propped with the conductive ring 181', 183', and 185' via the conductive members 21, 23, and 25. Provided is the feature that the prongs 131, 133, and 135 may rotate with the cover plate 11*b*, and also keep contact with the conductive rings 181', 183', and 185'.

In summation of the instant disclosure, the retractable power plug is provided as the prongs are configured to be rotatable or movable by a pressing means, especially the prongs are levelly rotatable and retractable for convenience.

While the above description constitutes the preferred embodiment of the instant disclosure, it should be appreciated that the invention may be modified without departing from the proper scope or fair meaning of the accompanying claims. Various other advantages of the instant disclosure will become apparent to those skilled in the art after having the benefit of studying the foregoing text and drawings taken in conjunction with the following claims.

What is claimed is:

1. A retractable power plug, comprising:

a cover body having a top portion with a plurality of holes;

a base located inside the cover body; an elastic element disposed between the base and the cover body; a locking unit disposed on the cover body;

a plurality of prongs separately pluggably disposed on the base; wherein, the base is combined with a bottom, when the bottom is pushed to move in the cover body, the bottom moves along with the base, and the prongs are exposed out of the holes of the cover body;

wherein, the locking unit is fixed to the position of the base, the prongs are retracted inside the cover body and the elastic element is compressed;

when the locking unit is unlocked, the elastic element is released to push the base back to an extended position.

2. The plug of claim 1, wherein the locking unit is formed as a rocker button; and one end of the locking unit is wedged with the base.

* * * * *